US006835323B2

(12) United States Patent
Hukkanen

(10) Patent No.: US 6,835,323 B2
(45) Date of Patent: Dec. 28, 2004

(54) AQUEOUS HYDRAULIC MEDIUM

(75) Inventor: Pentti Hukkanen, Oulu (FI)

(73) Assignee: Kemira Oyj, Helsinki (FI)

( * ) Notice: Subject to any disclaimer, the term of this patent is extended or adjusted under 35 U.S.C. 154(b) by 29 days.

(21) Appl. No.: 10/148,690

(22) PCT Filed: Dec. 1, 2000

(86) PCT No.: PCT/FI00/01058

§ 371 (c)(1),
(2), (4) Date: Jul. 31, 2002

(87) PCT Pub. No.: WO01/40398

PCT Pub. Date: Jun. 7, 2001

(65) Prior Publication Data

US 2003/0134967 A1 Jul. 17, 2003

(30) Foreign Application Priority Data

Dec. 2, 1999 (FI) ..... 19992592

(51) Int. Cl.[7] ..... C10M 173/02
(52) U.S. Cl. ..... 252/76; 252/72; 252/77
(58) Field of Search ..... 252/72, 76, 77

(56) References Cited

U.S. PATENT DOCUMENTS

| | | | | | |
|---|---|---|---|---|---|
| 2,233,185 | A | | 2/1941 | Smith | |
| 2,455,961 | A | | 12/1948 | Walker | |
| 3,159,580 | A | | 12/1964 | Hammer et al. | |
| 4,205,993 | A | * | 6/1980 | Rosenberg et al. | 106/726 |
| 4,615,827 | A | | 10/1986 | Small, Jr. | |
| 5,104,562 | A | * | 4/1992 | Kardos et al. | 252/79 |
| 5,449,470 | A | | 9/1995 | Cahoon et al. | |
| 5,451,334 | A | | 9/1995 | Bongardt et al. | |
| 5,807,810 | A | * | 9/1998 | Blezard et al. | 507/103 |
| 6,100,222 | A | * | 8/2000 | Vollmer et al. | 507/113 |

FOREIGN PATENT DOCUMENTS

| | | | |
|---|---|---|---|
| DE | 195 10 012 A1 | | 9/1996 |
| EP | 0 259 939 | | 3/1988 |
| EP | 0369692 | * | 5/1990 |
| EP | 0 572 113 A1 | | 12/1993 |
| EP | 0 761 805 A2 | | 3/1997 |
| GB | 793 141 | | 4/1958 |
| GB | 2 250 761 A | | 6/1992 |
| WO | 93/09198 | * | 5/1993 |
| WO | WO96 34076 | | 10/1996 |
| WO | 96/39472 | * | 12/1996 |
| WO | WO 97/26311 A1 | | 7/1997 |

OTHER PUBLICATIONS

Derwent abstract ACC–NO 1995–352752, of EP677563 A1 (Oct. 18, 1995).*
Derwent abstract of JP 19760106328 (Mar. 28, 1978).
Questel abstract of FI 101547 B (Jul. 15, 1998).
Derwent abstract of DE 19510012 A1 (Sep. 26, 1996).

* cited by examiner

*Primary Examiner*—Matthew A. Thexton
(74) *Attorney, Agent, or Firm*—Birch, Stewart, Kolasch & Birch, LLP

(57) ABSTRACT

The invention relates to an aqueous composition comprising a salt of formic acid for use as a hydraulic medium in hydrostatic transmission of power.

16 Claims, No Drawings

AQUEOUS HYDRAULIC MEDIUM

This application is the national phase under 35 U.S.C. §371 of PCT International Application No. PCT/FI00/01058 which has an International filing date of Dec. 1, 2000, which designated the United States of America.

FIELD OF INVENTION

The invention relates to an aqueous composition usable as a hydraulic medium in hydrostatic transmission of power. The invention also relates to the use of certain salts and their aqueous solutions as a hydraulic medium and in a hydraulic medium.

DESCRIPTION OF RELATED ART

Hydraulic media used for transmitting energy in hydrostatic power transmission play a substantial role in hydraulics. In the first hydraulic applications taken into use, water was used as the medium. Water has certain commonly known disadvantages, such as freezing at low temperatures, poor lubrication properties, and it also forms a favorable growth environment for microbes, from which there results formation of precipitates, bad odor, corrosion, and even generation of hydrogen, which may cause hydrogen brittleness in structural materials.

These disadvantages have been eliminated in hydraulics currently in use by using as the medium, for example, mineral oils, and recently also vegetable oils, to decrease the harm caused to the natural environment by mineral oils. Both vegetable and mineral oils have the disadvantage that their viscosities increase to detrimentally high levels at low temperatures. For most of the hydraulic oils, the lowest possible operating temperature is between −20 and −30° C. Oils and fats have a further disadvantage in that they form a growth medium for microbes. Combustibility is also a serious common detrimental factor because of which efforts are being made to reduce the use of oils.

U.S. Pat. No. 5,451,334 discloses a possibility to avoid the untoward properties of mineral oils by using as the main component purified rapeseed oil or soybean oil, to which an anti-oxidant in an amount of 0.5–5% and large-molecular esters in an amount of at minimum 20% have been added. In this manner the congealing point of the oil can be lowered from the normal −16° C. to as low as −40–−45° C.

WO-9726311 discloses a heavy fluid, intended mainly for oil drilling, the fluid consisting of a polymer to increase the viscosity of the aqueous solution and an aqueous solution containing cations and anions so that the solution has either two cations or two anions. The objective is a fluid having high stability with respect to aging, heat, mechanical stress and slide stress.

DE-19 510 012 discloses a salt solution or a fluid medium for use in fluid circulations such as solar energy units, heat pumps, thermostats, vehicle cooling circulations or hydraulic circulations intended for heat transmission, or in pipes in which hot or cold energy can be transmitted in a fluid medium and there is the risk of the temperature dropping below the freezing point of water or the congealing point of the medium. The salt solution or the fluid medium is a mixture of water and a salt of propionic acid. According to the publication, in the manner disclosed the disadvantages of mixtures of water and glycol and mixtures of water and chloride, which have been used previously, are avoided and the foodstuff provisions are complied with. The medium disclosed does not burn or explode and is odorless, and according to the publication it can be used at temperatures as low as −50° C. One further use suggested is aqueous hydraulics.

DESCRIPTION OF INVENTION

It has now been observed, surprisingly, that most of the disadvantages of prior art in hydraulics can be avoided by using as the hydraulic medium formate solutions which contain salts of formic acids. Such solutions are already used at present, for example, as heat transmission media owing to their environment-friendliness, low freezing points and also low viscosities at low temperatures.

According to the invention, there is thus provided an aqueous composition for use as a hydraulic medium in hydrostatic power transmission, which composition comprises an aqueous solution of a salt of formic acid.

The salt of formic acid may be an alkali metal salt of formic acid such as a sodium or potassium salt, an alkaline-earth metal salt such as a calcium or magnesium salt, or an ammonium salt. Potassium formate is an especially advantageous salt of formic acid.

The suitable concentration of the salt of formic acid is approx. 1–75% by weight, preferably approx. 5–60% by weight, and especially preferably approx. 10–60% by weight, depending on the targeted use.

The aqueous composition according to the invention may additionally contain additives, such as a thickener and/or a corrosion inhibitor.

The suitable amount of thickener is approx. 0.1–5% by weight, preferably approx. 0.2–1.0% by weight. Preferable thickeners include acrylic acid polymers and co-polymers, of which sodium polyacrylate and a copolymer of sodium acrylate and acrylamide can be mentioned.

The invention also relates to the use of an aqueous solution of a salt of formic acid as a hydraulic medium.

The invention additionally relates to the use of a salt of formic acid in an aqueous hydraulic medium, wherein the salt of formic acid has an inhibiting effect on microbial growth and a lowering effect on the freezing point, as well as a lowering effect on viscosity at low temperatures.

In comparison with the mixture of water and a salt of propionic acid proposed in DE published application 19 510 012, the following advantages are achieved with the aqueous solutions of salts of formic acid according to the present invention, i.e. formate solutions.

Formate solutions have lower freezing points. It is stated that with the sodium propionate solution disclosed in DE-19 510 012 a temperature of −50° C. can be attained, whereas with a 50-percent potassium formate solution a temperature of −60° C. can be attained, and temperatures even lower than this can be attained by using a stronger solution.

Furthermore, the viscosities of formate solutions at low temperatures are lower than those of corresponding propionate solutions. For example, the viscosity of a 50-percent aqueous solution of potassium formate at −40° C. is 18.9 cSt.

Formic acid, which is used for the preparation of formates, is more effective against microbes than is propionic acid. For example, against the *Pseudomonas putila* bacterium the EC 50 value of formic acid is 46.7 mg/l and the corresponding value of propionic acid is 59.6 mg/l. It can be assumed that the ratios of the corresponding property of corresponding salts of the said acids are the same.

The invention is described below in greater detail with the help of examples. The percentages given in the present specification are percentages by weight, unless otherwise indicated.

EXAMPLE 1

In this example, the antimicrobial action of potassium formate was investigated, and the test results presented below show that potassium formate does not form a growth medium for microbes.

The following test solutions were used in the test:

"Fr/used 3 yr." is a potassium formate solution which had been used in a refrigeration plant for 3 years as a heat transmission medium;

"Fr" is a potassium formate solution which is intended for use as a heat trasmission medium and into which there has been blended, because of this targeted use, a small amount of a corrosion inhibitor to protect the apparatus against corrosion;

"Kfo" is a potassium formate solution; and

"rapeseed oil" is a commercial rapeseed oil.

The test was conducted so that each solution to be investigated was taken into two plastic sample flasks, 60 ml into each. One of the two flasks was inoculated with 2 g of paper-industry waste paste containing various microbes, such paste being known as a favorable growth medium for microbes. After mixing, the samples were allowed to stand at room temperature for 2 days.

Culture tests were performed on the samples in a laboratory specialized in microbiologic assays. The assay methods were as follows.

The assay of aerobic bacteria was performed using a PCA substrate and incubation for 2 days at 37° C. For the assay of anaerobic bacteria, Brewer's agar and incubation for 2 days in anaerobic vessels at 37° C. were used. In the assay of slime-forming bacteria, PCA-agar+saccharose 50 g/l and incubation for 2 days at 37° C. were used. The slimy colonies were counted. Yeasts and molds were assayed using a Saboraud maltose agar substrate and incubation for 3–4 days at 30° C.

The analysis results are shown in the following Table 1.

TABLE 1

Quantities of microbes in samples contaminated with a bacterial inoculation and in uncontaminated samples.

| | Bacteria, number/ml | | | Fungi, number/ml | |
|---|---|---|---|---|---|
| Samples | Aerobic | Anaerobic | Possibly forming slime | Yeasts | Molds |
| Fr/used 3 yr. | <100 | <100 | <100 | <100 | <100 |
| Fr/used 3 yr. + inoculum | 600 | <100 | | <100 | <100 |
| 24% Fr | <100 | <100 | <100 | <100 | <100 |
| 24% Fr + inoculum | <100 | <100 | <100 | <100 | <100 |
| 24% Kfo | <100 | <100 | <100 | <100 | <100 |
| 24% Kfo + inoculum | 600 | 3600 | <100 | <100 | <100 |
| 50% Kfo | <100 | <100 | <100 | <100 | <100 |
| 50% Kfo + inoculum | 200 | <3500 | <100 | <100 | <100 |
| 50% Fr | <100 | <100 | <100 | <100 | <100 |
| 50% Fr + inoculum | 100 | <100 | <100 | <100 | <100 |
| Rapeseed oil | 120 000 | 500 | <100 | <100 | <100 |
| Rapeseed oil + inoculum | 2 100 000 | 30 000 | <100 | <100 | <100 |
| Bacterial inoculum (spoiled waste paste) | 6 200 000 | 290 000 | 100 | <200 | 1900 |

The results shown in Table 1 indicate that formate solutions not inoculated with microbes were completely free of aerobic, anaerobia and slime-forming bacteria as well as of yeasts and molds after a two-day culture, and that formate solutions inoculated with microbes had been capable of destroying the microbes almost totally within two days. On the other hand, the results show clearly that the growth of aerobic and anaerobic bacteria was vigorous in rapeseed oil, and in particular in rapeseed oil inoculated with microbes.

EXAMPLE 2

The viscosity of hydraulic fluids should preferably be within a range of 20–40 cSt. The viscosity should not be too low. If the viscosity is very low, for example in the order of 1 cSt, simple o-ring seals have to be abandoned in hydraulic equipment and other options have to be used. It is possible to increase the viscosity of a potassium formate solution by adding to the solution, for example, sodium polyacrylate or some other thickener, of which there are known numerous.

The present example investigated the possibility of affecting the viscosity of potassium formate by adding, at different temperatures, in an amount of 0.15%, Fennopol A 392 (a copolymer of sodium acrylate and acrylamide) manufactured by the Vaasa plant of Kemira Chemicals Oy. Under the effect of this thickener the viscosity of a 50-percent potassium formate solution increases in the manner shown in Table 2.

TABLE 2

Effect of thickener on the viscosity of a potassium formate solution

| Temperature, ° C. | Viscosity of unthickened solution, cSt | Viscosity of thickened solution, cSt |
|---|---|---|
| −20 | 7 | 43 1) |
| +20 | 2.1 | 9 |
| +50 | 1.3 | 6 |

1) precise measuring temperature −18° C.

If higher viscosities are desired, it is possible to attain them by adding more thickener. Thus it is possible to modify the solution so as to be suitable for any given use. The retention of the thickener in the solution also at low temperatures was observed by cooling the solution in a freezer to a temperature of −28° C., the solution remaining clear.

A formate solution according to that presented in the invention, such as potassium formate, can, after it has been discarded, be disposed of by passing it through a wastewater treatment plant, as long as care is taken to control the pH of the water being treated. Microbes carrying out a biological purification process can use for nutrition the carbon present in the formate.

What is claimed is:

1. A device which hydrostatically transmits power, comprising a housing which contains a hydraulic medium, wherein the hydraulic medium is an aqueous single salt system consisting essentially of an aqueous solution of a salt of formic acid, and wherein the aqueous solution contains the salt of formic acid in an amount of about 1% to 75% by weight.

2. The device according to claim 1, wherein the salt of formic acid is an alkali metal salt, an alkaline-earth metal salt or an ammonium salt.

3. The device according to claim 1, wherein the salt of formic acid is potassium formate.

4. The device according to claim 1, wherein the aqueous solution contains the salt of formic acid in an amount of about 5% to 60% by weight.

5. The device according to claim 1, wherein the aqueous solution additionally contains a thickener.

6. The device according to claim 5, wherein the amount of thickener is about 0.1% to 5% by weight.

7. The device according to claim 5, wherein the thickener comprises a polymer or copolymer of acrylic acid.

8. The device according to claim 1, wherein the aqueous solution additionally contains a corrosion inhibitor.

9. The device according to claim 5, wherein the amount of thickener is about 0.2% to 1.0% by weight.

10. The device according to claim 5, wherein the thickener comprises sodium polyacrylate or a copolymer of sodium acrylate and acrylamide.

11. The device according to claim 2, wherein the aqueous solution additionally contains a thickener and a corrosion inhibitor.

12. The device according to claim 11, wherein the thickener comprises a polymer or copolymer of acrylic acid and is present in an amount of about 0.1% to 5% by weight.

13. The device according to claim 1, wherein the aqueous solution contains the salt of formic acid in an amount of about 10% to 60% by weight.

14. The device according to claim 11, wherein the salt of formic acid is potassium formate.

15. The device according to claim 12, wherein the salt of formic acid is potassium formate.

16. The device according to claim 13, wherein the salt of formic acid is potassium formate.

* * * * *